United States Patent [19]

Trippi

[11] 4,073,159

[45] Feb. 14, 1978

[54] BYPASS DISPENSER UNIT FOR AUTOMATIC ICE MAKER

[76] Inventor: Anthony C. Trippi, 900 Fallen Leaf Road, Arcadia, Calif. 91006

[21] Appl. No.: 708,085

[22] Filed: July 23, 1976

[51] Int. Cl.[2] ..... F25C 1/00

[52] U.S. Cl. ..... 62/340; 62/390; 222/389

[58] Field of Search ..... 222/95, 105, 389; 62/340, 390, 348, 306

[56] References Cited

U.S. PATENT DOCUMENTS

| | | | |
|---|---|---|---|
| 1,630,899 | 5/1927 | Lynch | 222/389 X |
| 3,003,322 | 10/1961 | Jordan | 222/95 X |
| 3,642,174 | 2/1972 | Cornelius | 62/306 X |
| 3,738,775 | 6/1973 | Strickland | 222/95 X |
| 3,828,572 | 8/1974 | Calim | 62/340 |

FOREIGN PATENT DOCUMENTS

| | | | |
|---|---|---|---|
| 570,451 | 9/1961 | Belgium | 222/95 |

*Primary Examiner*—William E. Wayner
*Assistant Examiner*—William E. Tapolcai, Jr.
*Attorney, Agent, or Firm*—Christie, Parker & Hale

[57] ABSTRACT

In combination with a refrigeration unit having a water supply inlet for receiving water from a pressurized water supply source, a dispenser unit including a sealed chamber having a collapsible container for fruit juice or the like. The chamber is connected to the water supply and the collapsible container is connected to the inlet of the refrigeration unit. The pressure of the water supply collapses the container, forcing the juice in the container to the ice maker as demanded by the metering system of the ice maker for freezing the juice into cubes.

2 Claims, 1 Drawing Figure

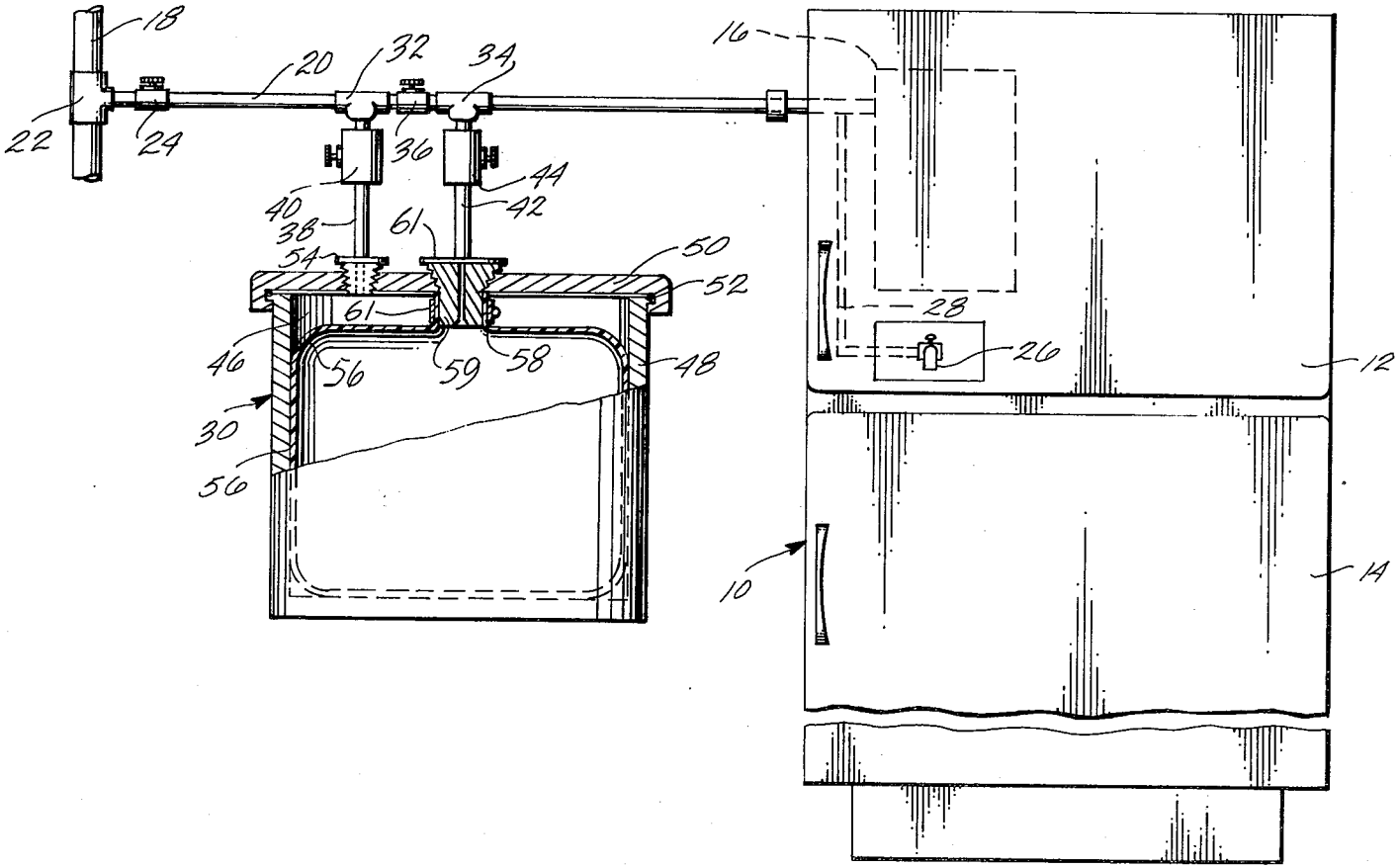
12
14
26
28
16
10
50
52
48
44
42
34
58
59
32
36
61
61
56
20
40
38
54
46
30
56
18
24
22

BYPASS DISPENSER UNIT FOR AUTOMATIC ICE MAKER

FIELD OF THE INVENTION

This invention relates to dispensers for chilled or frozen juices or the like.

BACKGROUND OF THE INVENTION

Home refrigerators are well known which have automatic ice makers in the freezer compartment which provide continuous supply of ice cubes. Some refrigerator units may also provide spigots for dispensing chilled water, fruit juices, or other beverages. The supply of water to the automatic ice maker and the water spigot is provided by connecting an inlet to the refrigeration unit to a cold water line. Juices and other beverages dispensed are merely stored in containers in the refrigeration unit and dispensed by gravity through the appropriate spigots.

SUMMARY OF THE INVENTION

The present invention is directed to an arrangement for providing either water or other liquid beverages, such as fruit juices under pressure to the refrigeration unit so that the juice or other beverage can be frozen into cubes by the ice maker and/or dispensed under pressure as a chilled beverage from the spigot. The juice dispenser, by being connected to the same inlet as the water supply, can be delivered in pure concentrated form or premixed and diluted with water in any proportion. The dispenser can store the juice in a wide range of convenient quantities.

These and other advantages of the present invention are achieved, in brief, by providing a dispenser for chilled or frozen fruit juices or the like comprising a refrigeration unit having an automatic ice maker and/or chilled liquid dispensing spigot connected to a source of water under pressure. A sealed chamber connected to the water source has a collapsible container mounted inside the chamber for storing the juice to be dispensed. The collapsible container is connected through a separate outlet fluid line to the inlet to the refrigeration unit. By directing water under pressure into the chamber, pressure is applied to the collapsible container forcing the juice under pressure to the refrigeration unit either in pure form or mixed with water from the supply.

DESCRIPTION OF THE DRAWING

For a more complete understanding of the invention reference should be made to the accompanying drawing, wherein the single FIGURE is a plan view partly in section of the invention.

DETAILED DESCRIPTION

Referring to the drawing in detail, the numeral 10 indicates generally a conventional refrigerator having a freezer section 12 and a food chilling section 14. The freezer section includes an automatic ice maker 16 of the type which freezes water into ice cubes. The ice maker 16 is connected to a cold water pipe 18 which is part of the household water supply system. Water is connected from the supply line 18 to the water intake line to the refrigeration unit 10 through a supply line 20 which conventionally is in the form of a small flexible copper tubing. The tubing is connected to the water pipe 18 through a standard T connection 22 and shut-off valve 24. The refrigeration unit 10 may also include a cold water spigot 26 which is internally connected through suitable cooling coils 28 mounted in the walls of the refrigerator and connected to the water inlet for the ice maker 16.

The present invention includes a dispenser unit, indicated generally at 30, which is connected into the supply line 20 through a pair of T-connectors 32 and 34. A bypass valve 36 is connected in the line 20 between the T-connectors 32 and 34. An input line 38 is connected to the T-connector through a shut-off valve 40. An outlet pipe 42 is connected to the T-connector 34 through a shut-off valve 44.

The dispenser 30 is in the form of a rigid outer container forming a sealed chamber 46. The rigid container includes a canister 48 having a removable lid 50. The lid is preferably joined to the canister by a conventional bayonet-type connection, a gasket 52 providing a pressure type seal between the lid and the canister. The inlet tubing or pipe 38 opens into the chamber 46 through a fitting 54 in the lid.

A collapsible flexible plastic container 56 filled with the juice or other liquid to be dispensed is placed inside the canister 48. The neck 58 of the plastic container 56 fits around a nipple 59 projecting from a fitting 60 projecting from the inside of the lid 50 and is clamped around the nipple 59 by a clamping band 61. The fitting 60 is attached to the output line 42.

In operation, with the valve 36 open and the valves 40 and 44 shut, water is provided to the automatic ice cube maker 16 and spigot 26 in conventional manner. With the flexible container 56 filled with juice or other liquid, valve 36 is closed and valves 40 and 44 are opened. Water under pressure is thereby directed to the intake pipe 38 to the sealed chamber 46, applying an external pressure to the collapsible bag 56. This forces the juice from the collapsible container through the outlet pipe 42 to the inlet of the refrigerator 10. Thus pure juice is provided to the automatic ice maker 16 and the spigot 26. If it is desired to dilute a juice concentrate stored in the flexible container 56, the valve 36 may be partially opened at the same time the valves 40 and 44 are open allowing a mixture of water and juice to be supplied to the input to the refrigerator unit 10. The canister 48 may be made of a transparent material or may be provided with a window or other suitable means for noting the extent to which the flexible container has been emptied. When fully collapsed, the flexible container can be refilled or replaced with a full container by shutting off the valves 40 and 44 and removing the canister 48. The canister is emptied of any water, and a freshly filled collapsible container 56 is connected to the nipple 59.

From the above description it will be seen that an arrangement is provided for bypassing the delivery system to an automatic ice maker to permit freezing of other liquids suitable for freezing into ice cubes, such as fruit juices, vegetable juices, and the like. The unit can be attached to the water supply of any existing ice making unit. The dispenser is operated by the available water pressure and the collapsible container for the juice can be easily replaced, refilled, or disposed of. Furthermore, the collapsible container can be made in any number of convenient sizes, the maximum size being limited only by the size of the canister 48. While the dispenser has been shown as located outside the refrigeration unit, it can be built into the refrigeration unit, if desired. For example, the dispenser may be located in the food storage portion 14 of the refrigerator so that the juice in the dispenser is maintained in a chilled condition at all times.

What is claimed is:

1. A dispenser for chilled or frozen fruit juices or the like, comprising a refrigeration unit, means connecting a source of water under pressure to the refrigeration unit, a sealed chamber, means for directing water from the water source into the chamber, a collapsible container mounted inside the chamber for storing the juice to be dispensed, and means connecting the container to the refrigeration unit for providing juice from the container to the refrigeration unit as the container is compressed under pressure of the water supply source, the refrigeration unit including an automatic ice maker, valve means selectively coupling water from said supply source and juice from the container to said ice maker, the ice maker having a single input line for delivering liquid to the ice maker, said valve means including means for connecting both the container and water supply source to the ice maker input line.

2. In combination with a refrigeration unit having a water supply inlet for receiving water from a pressurized water supply source, a dispenser unit including means providing a sealed chamber, a collapsible fluid container positioned in the chamber, means fluid connecting the chamber to the water supply source for applying pressure to the container, means fluid connecting the collapsible fluid container to the inlet of the refrigeration unit, and mixing valve means connecting fluid from the supply mixed with fluid from the container to the inlet of the refrigeration unit.

* * * * *